US007451791B2

(12) United States Patent
Cooper et al.

(10) Patent No.: US 7,451,791 B2
(45) Date of Patent: Nov. 18, 2008

(54) HANDLE ASSEMBLY

(75) Inventors: Randy G. Cooper, Jackson, TN (US); Mark A. Etter, Humboldt, TN (US); Greg K. Griffin, Humboldt, TN (US); Ginger L. Allen, Jackson, TN (US); Derrick Kilbourne, Jackson, TN (US); Jeremy D. Leasure, Jackson, TN (US)

(73) Assignee: Black & Decker Inc., Newark, DE (US)

( * ) Notice: Subject to any disclaimer, the term of this patent is extended or adjusted under 35 U.S.C. 154(b) by 419 days.

(21) Appl. No.: 10/730,637

(22) Filed: Dec. 8, 2003

(65) Prior Publication Data

US 2008/0156396 A1 Jul. 3, 2008

Related U.S. Application Data

(63) Continuation-in-part of application No. 10/686,300, filed on Oct. 15, 2003.

(60) Provisional application No. 60/467,169, filed on May 1, 2003, provisional application No. 60/418,510, filed on Oct. 15, 2002.

(51) Int. Cl.
*B27C 5/10* (2006.01)

(52) U.S. Cl. ..... 144/136.95; 144/154.5; 144/252.1; 409/137; 409/182

(58) Field of Classification Search ..... 144/136.95, 144/154.5, 252.1; 30/475, 478; 409/182, 409/137; 16/110.1, 421; 408/67
See application file for complete search history.

(56) References Cited

U.S. PATENT DOCUMENTS

| | | | | |
|---|---|---|---|---|
| 712,843 | A | 11/1902 | Paul | |
| 1,370,895 | A | 3/1921 | Loomis | |
| 1,514,894 | A | 11/1924 | Carter | |
| 1,565,790 | A | 12/1925 | Carter | |
| 1,584,078 | A | 5/1926 | Carter | |
| 1,820,162 | A | 8/1931 | Salvat | |
| 1,874,232 | A | 8/1932 | Groene et al. | |
| 2,353,202 | A | 7/1944 | Tautz | 144/134 |
| 2,425,245 | A | 8/1947 | Johnson | 121/36 |
| 2,504,880 | A | 4/1950 | Rittenhouse | 143/43 |

(Continued)

FOREIGN PATENT DOCUMENTS

| | | |
|---|---|---|
| CA | 500134 | 2/1954 |
| CA | 657748 | 2/1963 |
| CA | 2314653 | 7/2000 |
| GB | 712071 | 4/1952 |
| GB | 1037969 | 9/1965 |

(Continued)

OTHER PUBLICATIONS

Triton ½Precision Router (TRA 001), http://www.triton.net.au/products/router 2.html, p.1-3, Feb. 27, 2004.

(Continued)

*Primary Examiner*—Shelley Self
(74) *Attorney, Agent, or Firm*—Scott B. Markow; Adan Ayala

(57) ABSTRACT

The present invention is directed to an apparatus for providing convenient grasping of a router adjacent base/motor housing includes a base for supporting a motor housing for driving a working tool. A generally L-shaped handle including a connecting member and grasping member is connected to the base for permitting a user to comfortably manipulate the power tool adjacent the motor housing. In further aspect, a removable a generally L-shaped handle includes a channel extending through the handle for directing dust and debris away from the working tool.

42 Claims, 9 Drawing Sheets

U.S. PATENT DOCUMENTS

| | | | | | |
|---|---|---|---|---|---|
| 2,513,894 | A | | 7/1950 | Rogers | 206/17 |
| 2,630,152 | A | * | 3/1953 | Turnbull | 144/136.95 |
| 2,799,305 | A | | 7/1957 | Groehn | 144/253 |
| 3,289,718 | A | | 12/1966 | Willis | 144/136 |
| 3,436,090 | A | | 4/1969 | Lange et al. | 280/11.37 |
| 3,443,479 | A | | 5/1969 | Hawley et al. | 90/12 |
| 3,451,133 | A | | 6/1969 | Hathaway et al. | 32/22 |
| 3,466,973 | A | | 9/1969 | Rees | 90/12 |
| 3,481,453 | A | | 12/1969 | Shreve III, et al. | 206/45.14 |
| 3,487,747 | A | | 1/1970 | Burrows et al. | 90/11 |
| 3,494,395 | A | | 2/1970 | Graham | 144/136 |
| 3,512,740 | A | | 5/1970 | Podwalny | 248/154 |
| 3,587,387 | A | | 6/1971 | Burrows et al. | 90/12 |
| 3,710,833 | A | | 1/1973 | Hammer e tal. | 144/134 A |
| 3,767,948 | A | | 10/1973 | Batson | 310/50 |
| 3,791,260 | A | | 2/1974 | Ambler et al. | 90/12 D |
| 3,827,820 | A | | 8/1974 | Hoffman | 403/165 |
| 3,905,273 | A | | 9/1975 | Shook | 90/11 R |
| 4,051,880 | A | | 10/1977 | Hestily | 144/252 R |
| 4,085,552 | A | | 4/1978 | Horine et al. | 51/166 R |
| 4,102,370 | A | | 7/1978 | Vess | 144/134 D |
| 4,108,225 | A | | 8/1978 | Hestily | 144/134 D |
| 4,143,691 | A | | 3/1979 | Robinson | 144/134 D |
| 4,239,428 | A | | 12/1980 | Berzina | 409/182 |
| 4,294,297 | A | | 10/1981 | Kieffer | 144/134 D |
| 4,319,860 | A | | 3/1982 | Beares | 409/182 |
| D267,492 | S | | 1/1983 | Schieber | D5/141 |
| 4,410,022 | A | | 10/1983 | Peterson | 144/1 F |
| 4,445,811 | A | | 5/1984 | Sanders | 409/182 |
| 4,537,234 | A | | 8/1985 | Onsrud | 144/134 A |
| 4,562,872 | A | | 1/1986 | Fushiya et al. | 144/134 |
| 4,593,466 | A | | 6/1986 | O'Brien | 30/272 A |
| D286,132 | S | | 10/1986 | Yamamoto | D8/67 |
| 4,615,654 | A | | 10/1986 | Shaw | 409/178 |
| 4,652,191 | A | | 3/1987 | Bernier | 409/182 |
| 4,679,606 | A | | 7/1987 | Bassett | 144/134 A |
| 4,718,468 | A | | 1/1988 | Cowman | 144/134 D |
| 4,738,571 | A | | 4/1988 | Olson et al. | 409/137 |
| 4,770,573 | A | | 9/1988 | Monobe | 409/182 |
| D300,501 | S | | 4/1989 | Zurwelle | D8/67 |
| 4,830,074 | A | | 5/1989 | Lundblom | 144/251 B |
| RE33,045 | E | | 9/1989 | Gronholz, deceased et al. | 144/134 |
| 4,872,550 | A | | 10/1989 | Stranges | 206/315.1 |
| 4,924,571 | A | | 5/1990 | Albertson | 30/121 |
| 4,938,642 | A | * | 7/1990 | Imahashi et al. | 409/182 |
| 5,012,582 | A | | 5/1991 | Bristol et al. | 30/391 |
| 5,025,841 | A | | 6/1991 | Totten | 144/134 R |
| 5,031,323 | A | * | 7/1991 | Honsa et al. | 30/276 |
| 5,056,375 | A | | 10/1991 | Kapton et al. | 74/89.15 |
| 5,062,460 | A | | 11/1991 | DeLine | 144/136 |
| 5,074,724 | A | | 12/1991 | McCracken | 409/182 |
| 5,078,557 | A | | 1/1992 | McCracken | 409/182 |
| D323,935 | S | | 2/1992 | Ward | D3/73 |
| 5,088,865 | A | | 2/1992 | Beth et al. | 409/182 |
| 5,094,575 | A | | 3/1992 | Keiser et al. | 409/182 |
| D326,597 | S | | 6/1992 | Lee | D8/68 |
| 5,117,879 | A | | 6/1992 | Payne | 144/1 F |
| 5,139,061 | A | | 8/1992 | Neilson | 144/134 A |
| 5,181,813 | A | | 1/1993 | McCracken | 409/182 |
| 5,188,492 | A | | 2/1993 | McCracken | 409/182 |
| 5,191,621 | A | | 3/1993 | Brok | 382/1 |
| D337,501 | S | | 7/1993 | Witt | D8/70 |
| D340,174 | S | | 10/1993 | Hoshino et al. | D8/67 |
| D341,305 | S | | 11/1993 | Svetlik | D8/70 |
| 5,265,657 | A | | 11/1993 | Matsumoto et al. | 144/134 D |
| 5,273,089 | A | | 12/1993 | Fuchs et al. | 144/134 D |
| 5,289,861 | A | | 3/1994 | Hedrick | 144/134 A |
| 5,308,201 | A | | 5/1994 | Wilson et al. | 409/134 |
| D349,637 | S | | 8/1994 | Hoshino et al. | D8/67 |
| 5,347,684 | A | * | 9/1994 | Jackson | 16/421 |
| 5,353,474 | A | | 10/1994 | Good et al. | 16/111 R |
| 5,353,852 | A | | 10/1994 | Stolzer et al. | 144/134 D |
| 5,361,851 | A | | 11/1994 | Fox | 173/170 |
| 5,368,424 | A | | 11/1994 | Bettenhausen | 409/182 |
| 5,429,235 | A | | 7/1995 | Chen | 206/373 |
| 5,445,479 | A | | 8/1995 | Hillinger | 408/16 |
| 5,452,751 | A | | 9/1995 | Engler, III et al. | 144/1 F |
| 5,469,601 | A | | 11/1995 | Jackson | 16/111 R |
| 5,511,445 | A | | 4/1996 | Hildebrandt | 745/558.5 |
| 5,584,620 | A | | 12/1996 | Blickhan et al. | 409/137 |
| 5,590,989 | A | | 1/1997 | Mulvihill | 409/182 |
| 5,598,892 | A | | 2/1997 | Fox | 173/170 |
| 5,613,813 | A | | 3/1997 | Winchester et al. | 409/182 |
| 5,640,741 | A | | 6/1997 | Yano | 16/114 R |
| 5,652,191 | A | | 7/1997 | Patterson | 502/162 |
| 5,662,440 | A | | 9/1997 | Kikuchi et al. | 409/182 |
| 5,667,565 | A | * | 9/1997 | Gondar | 96/60 |
| 5,671,789 | A | | 9/1997 | Stolzer et al. | 144/154.5 |
| 5,678,965 | A | | 10/1997 | Strick | 409/132 |
| 5,699,844 | A | | 12/1997 | Witt | 144/329 |
| 5,725,036 | A | | 3/1998 | Walter | 144/135.2 |
| 5,772,368 | A | | 6/1998 | Posh | 409/182 |
| 5,803,684 | A | | 9/1998 | Wang | 409/229 |
| 5,813,805 | A | | 9/1998 | Kopras | 408/241 R |
| 5,829,931 | A | | 11/1998 | Doumani | 409/132 |
| 5,845,688 | A | * | 12/1998 | Qian | 144/252.1 |
| 5,853,273 | A | | 12/1998 | Coffey | 409/182 |
| 5,853,274 | A | | 12/1998 | Coffey et al. | 409/182 |
| 5,902,080 | A | | 5/1999 | Kopras | 409/182 |
| 5,909,987 | A | | 6/1999 | Coffey et al. | 409/131 |
| 5,913,645 | A | | 6/1999 | Coffey | 409/182 |
| 5,918,652 | A | | 7/1999 | Tucker | 144/371 |
| 5,921,730 | A | | 7/1999 | Young et al. | 409/182 |
| D416,460 | S | | 11/1999 | Bosten et al. | D8/67 |
| 5,988,241 | A | | 11/1999 | Bosten et al. | 144/154.5 |
| 5,998,897 | A | | 12/1999 | Bosten et al. | 310/89 |
| 6,050,759 | A | | 4/2000 | Bone | 409/182 |
| 6,065,912 | A | | 5/2000 | Bosten et al. | 409/134 |
| 6,079,915 | A | | 6/2000 | Bosten et al. | 409/182 |
| 6,079,918 | A | | 6/2000 | Buddendeck et al. | 409/182 |
| 6,182,723 | B1 | | 2/2001 | Bosten et al. | 144/154.5 |
| 6,183,400 | B1 | | 2/2001 | Pope | 482/92 |
| D444,364 | S | | 7/2001 | Evans | D8/67 |
| 6,261,036 | B1 | | 7/2001 | Bosten et al. | 409/182 |
| 6,266,850 | B1 | | 7/2001 | Williams et al. | 16/430 |
| 6,289,952 | B1 | | 9/2001 | Jones et al. | 144/135.2 |
| 6,305,447 | B1 | | 10/2001 | Rousseau | 144/135.2 |
| 6,318,936 | B1 | | 11/2001 | McFarlin, Jr. et al. | 409/131 |
| 6,419,429 | B1 | | 7/2002 | Long et al. | 409/182 |
| 6,443,675 | B1 | | 9/2002 | Kopras et al. | 409/182 |
| 6,443,676 | B1 | | 9/2002 | Kopras | 409/182 |
| 6,474,378 | B1 | | 11/2002 | Ryan et al. | 144/154.5 |
| 6,505,659 | B1 | | 1/2003 | Hummel | 144/135.2 |
| 6,506,006 | B2 | * | 1/2003 | Lui et al. | 409/182 |
| 6,520,224 | B2 | | 2/2003 | Smith | 144/135.2 |
| 6,520,227 | B2 | | 2/2003 | Mc Farlin, Jr. et al. | 144/371 |
| D473,439 | S | | 4/2003 | Grant et al. | D8/61 |
| 6,550,154 | B1 | | 4/2003 | Smith | 33/638 |
| 6,725,892 | B2 | | 4/2004 | McDonald et al. | 144/136.95 |
| 6,726,414 | B2 | | 4/2004 | Pientka et al. | 409/182 |
| 6,739,066 | B2 | | 5/2004 | Smith | 33/638 |
| 6,779,954 | B2 | | 8/2004 | Tomayko | 409/182 |
| 6,792,984 | B2 | | 9/2004 | Fontaine | 144/135.2 |
| 2002/0020466 | A1 | | 2/2002 | McFarlin, Jr. et al. | 144/135.2 |
| 2002/0043294 | A1 | | 4/2002 | McDonald et al. | 144/154.5 |
| 2002/0079021 | A1 | | 6/2002 | Smith | 144/135.2 |
| 2003/0188441 | A1 | | 10/2003 | Patton | 30/381 |
| 2003/0205292 | A1 | | 11/2003 | Smith | 144/252.1 |
| 2003/0223835 | A1 | | 12/2003 | Hummel | 409/182 |
| 2004/0035495 | A1 | | 2/2004 | Hessenberger et al. | 144/136.95 |
| 2004/0194854 | A1 | | 10/2004 | McDonald et al. | 144/136.95 |
| 2004/0200543 | A1 | | 10/2004 | McDonald et al. | 144/136.95 |
| 2004/0250891 | A1 | | 12/2004 | McDonald et al. | 144/136.95 |

| | | | | |
|---|---|---|---|---|
| 2004/0253068 | A1 | 12/2004 | Gerhardt et al. | 409/182 |
| 2006/0067801 | A1 | 3/2006 | Van Bergen | |

FOREIGN PATENT DOCUMENTS

| | | |
|---|---|---|
| JP | 54051247 | 4/1979 |
| JP | 06164544 | 6/1991 |
| JP | 04297645 | 10/1992 |
| JP | 04297646 | 10/1992 |
| JP | 06136286 | 5/1994 |

OTHER PUBLICATIONS

Triton TRC-001, Router Woodworking, http://www.patwarner.com/triton.html, p. 1-2, Feb. 27, 2004.

Triton 3 ¼hp Plunge Router Review, http://benchmark.20m.com/reviews/TritonRouter/TritonRouterReview.html,, p. 1-4, Feb. 27, 2004.

http://www.dremel.com/productdisplay/tool_template2.asp?SKU=9000-04&Color=99CCFF, #9000-04 Advantage Rotary Saw Kit, Mar. 21, 2003, 1 page.

Bosch 1617 Shop Router, Parts Diagram, Jul. 1998.

Bosch Router Models, Owners Manual, p. 1-22, http//www.boschtools.com.

Triton TRC-001 Review, 3.25 Plunge Router, http://www.mv.com/users/besposito/woodworking/triton/, Feb. 27, 2004.

* cited by examiner

HANDLE ASSEMBLY

CROSS REFERENCE

The present application is a Continuation-in-Part and claims priority under 35 U.S.C. §120 to U.S. patent application Ser. No. 10/686,300, entitled Quick Release Sub-Base Router, filed on Oct. 15, 2003, which in-turn claims priority under 35 U.S.C. §119(e) to U.S. Provisional Patent Ser. No. 60/418,510, entitled: Router, filed on Oct. 15, 2002, and U.S. Provisional Patent Ser. No. 60/467,169, entitled: Router, filed on May 1, 2003 all of which are hereby incorporated by reference in their entirety.

The instant application hereby incorporates U.S. patent application Ser. No. 10/384,510, entitled Router Base Securing Mechanism, filed on Mar. 3, 2003 and U.S. patent application Ser. No. 10/458,167, entitled: Switch Assembly, filed on Jun. 10, 2003 by reference in their entirety.

FIELD OF THE INVENTION

The present invention generally relates to the field of power tools and more particularly to a handle assembly for a router.

BACKGROUND OF THE INVENTION

Woodworkers utilize routers to perform a wide variety of tasks such as forming decorative edges, cutting grooves, forming rails/stiles and the like. A router is often utilized in many woodworking projects due to its versatility. Presently, most routers either implement a knob-type of handle or a D-shaped handle. In either case, these handles may not meet user demands. For instance, knob-type handles may cause the user to crouch or to work on a higher work surface than he or she is accustomed in order to observe the tool's progress and to maintain secure control. D-handles on the other hand, may extend significantly away from motor housing, or may cause the user to extend his/her grasping arm behind the plane of their back so that his or her other hand may grasp knob handle disposed generally opposite the D-handle.

In other instances, some users wish to grasp the main body of the router. A drawback to grasping the main body of the router, such as the motor housing and the base, is that a user's hand may become more easily fatigued. For instance, a user grasping a router's motor housing may experience fatigue because he/she may tend to hold up his/her arm at an awkward angle or force their hand into an uncomfortable position.

Previous dust removal devices for routers typically are connected adjacent the base of the router. Often times, a vacuum hose connected adjacent the base may require repositioning during operation. For instance, a hose connected adjacent the base may require repositioning such as when a user is shaping the edge of a door panel.

Therefore, it would be desirable to provide a handle assembly for permitting ergonomic grasping, and particularly a handle assembly which may permit comfortable grasping of the main body of the router and dust removal.

SUMMARY OF THE INVENTION

Accordingly, the present invention is directed generally to a handle assembly for use in power tools, such as a router, and the like.

In a first aspect of the present invention, a power tool includes a base for supporting a motor housing for driving a working tool. A generally L-shaped handle including a connecting member and grasping member is connected to the base for permitting a user to comfortably manipulate the power tool adjacent the motor housing.

In a further aspect of the present invention, a removable base router includes a generally cylindrical motor housing for driving a working tool and a base having a base sleeve for receiving the motor housing and a support member. A generally L-shaped handle is configured to connect to the base sleeve such that the grasping member of the L-handle is disposed adjacent the motor housing.

In another aspect of the invention, a removable router base is configured with a generally L-shaped debris duct including a channel extending through the duct for directing dust and debris through the duct. In the current aspect, the L-shaped duct is connected to a sleeve portion of the base, about a debris aperture included in the base.

It is to be understood that both the foregoing general description and the following detailed description are exemplary and explanatory only and are not restrictive of the invention as claimed. The accompanying drawings, which are incorporated in and constitute a part of the specification, illustrate an embodiment of the invention and together with the general description, serve to explain the principles of the invention.

BRIEF DESCRIPTION OF THE DRAWINGS

The numerous advantages of the present invention may be better understood by those skilled in the art by reference to the accompanying figures in which.

DETAILED DESCRIPTION OF THE INVENTION

Reference will now be made in detail to the presently preferred embodiments of the invention, examples of which are illustrated in the accompanying drawings. Those of skill in the art will appreciate that the apparatus of the present invention may be implemented with various power tools such as a dedicated plunge router and a removable base plunge router without departing from the spirit and scope of the present invention.

Figure 1:
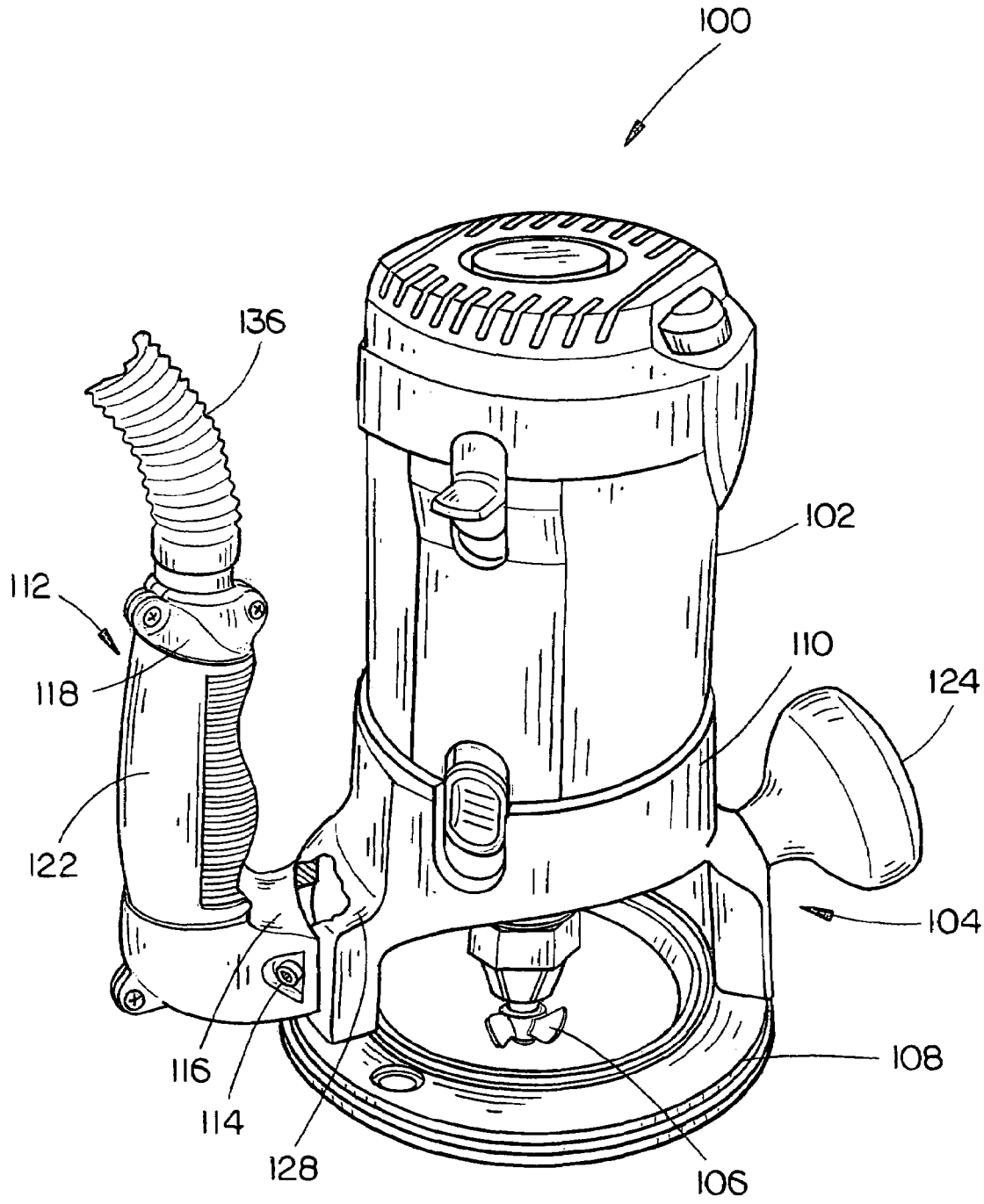
FIG. 1 is an isometric view illustrating a router including a generally L-shaped handle in accordance with an exemplary embodiment of the present invention.

Referring to FIG. 1, a router 100 in accordance with an exemplary embodiment of the present invention is described. In the present example, the router 100 is a standard or fixed base type router in which the motor housing 102 is removable from a base 104. The base 104 is configured to at least partially support the router 100 on a support surface or a workpiece. For instance, a user may support the router on a portion of the base while shaping a panel edge. When utilizing a fixed base router, the user adjusts the position of the motor housing 102 so that a bit 106 extends beyond the base to the desired depth. Once positioned, the motor housing is secured via a clamp or draw member disposed across a seam 220 (FIG. 2) in the base sleeve 110 so as to clamp the sleeve 110 about the motor housing 102.

The base 104 includes an upper portion or sleeve 110. Preferably, the sleeve 110 forms a generally cylindrical aperture for accepting a corresponding motor housing 102 therein. A base support member 108 is connected to the sleeve. In the current embodiment, the support member 108 is a generally flat circular plate to which a sub-base is connected. In an advantageous embodiment, the support member 108 and the sleeve member 110 are unitary. At least a portion of the base sleeve may have a generally cylindrical outer surface 128 to allow a user to grasp at least a portion of the sleeve/motor housing to manipulate the router. In additional instances, a removable sub-base plate is connected to the support member 108. A sub-base may be utilized for attaching a template guide, to minimize friction between the router base and the workpiece, to prevent marring, and the like.

Figure 10B:
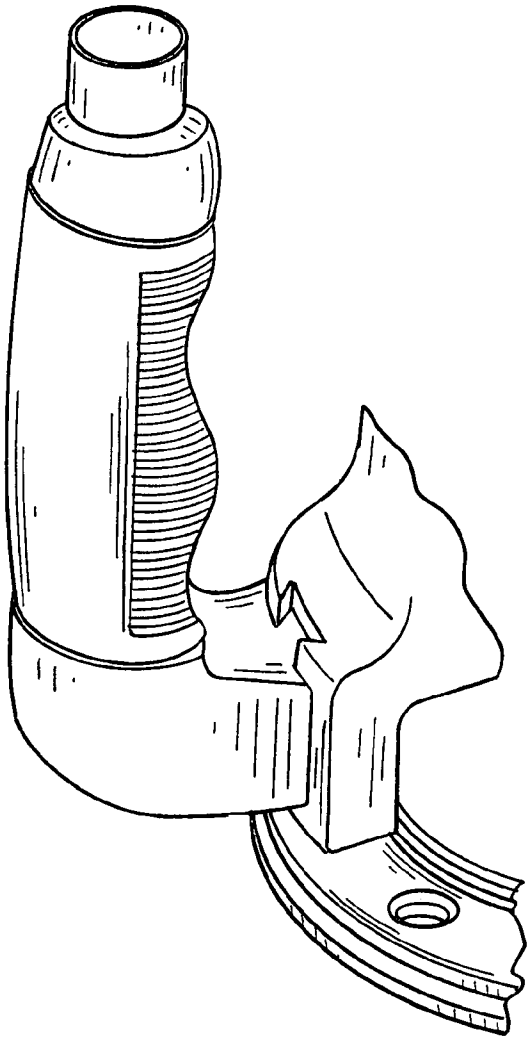
FIG. 10B is a view illustrating the connection of the generally L-shaped handle of FIG. 10A connected to a corresponding base.
Figure 10A:
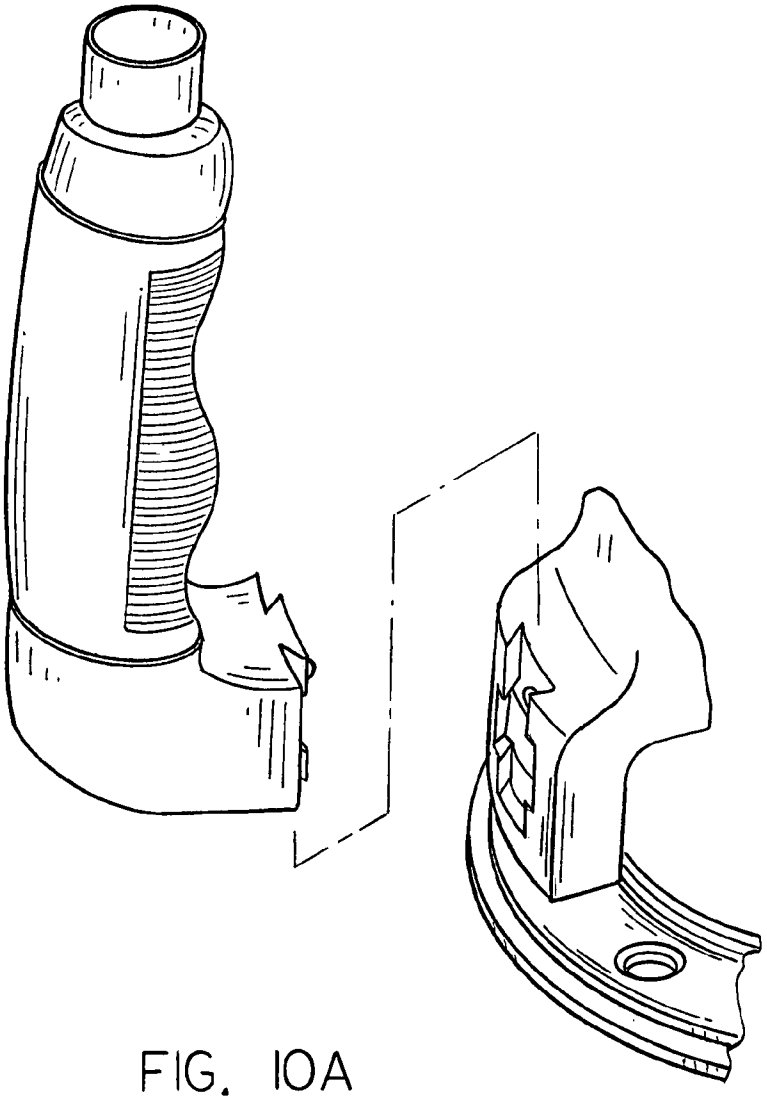
FIG. 10A is an exploded view indicating a generally L-shaped handle having a dovetailed terminal portion.

Referring again to FIG. 1, a generally L-shaped handle 112 is connected to the base sleeve 110. For example, the handle 112 is removably attached via a fastener such as a bolt, a set screw 114, a screw, a latch, a quick release latch, or the like, or by threading on the handle itself, for securing the handle 112 to the base. In another example, the L-shaped handle is interchangeable with a knob-type handle 124 so that a user may customize the handle arrangement as desired. Additionally, the handle may be unitary with the base or fixedly secured to the base by a weld or the like. Referring generally to FIGS. 10A and 10B, an L-shaped handle may be formed with a mechanical connection, such as a dovetailed terminal portion or the like, corresponding to a connection included on the base to secure and/or assist in securing the handle to the base.

In embodiments, an L-shaped handle is configured to permit retrofitting. For instance, an L-handle is configured to secure into an angled threaded aperture or the like for securing the handle to the base. When retrofitting is desired, an L-handle may be configured so as to dispose the grip substantially parallel with the router's motor housing such that a user may interchange a knob handle with an L-shaped handle of the present invention.

Figure 2A:
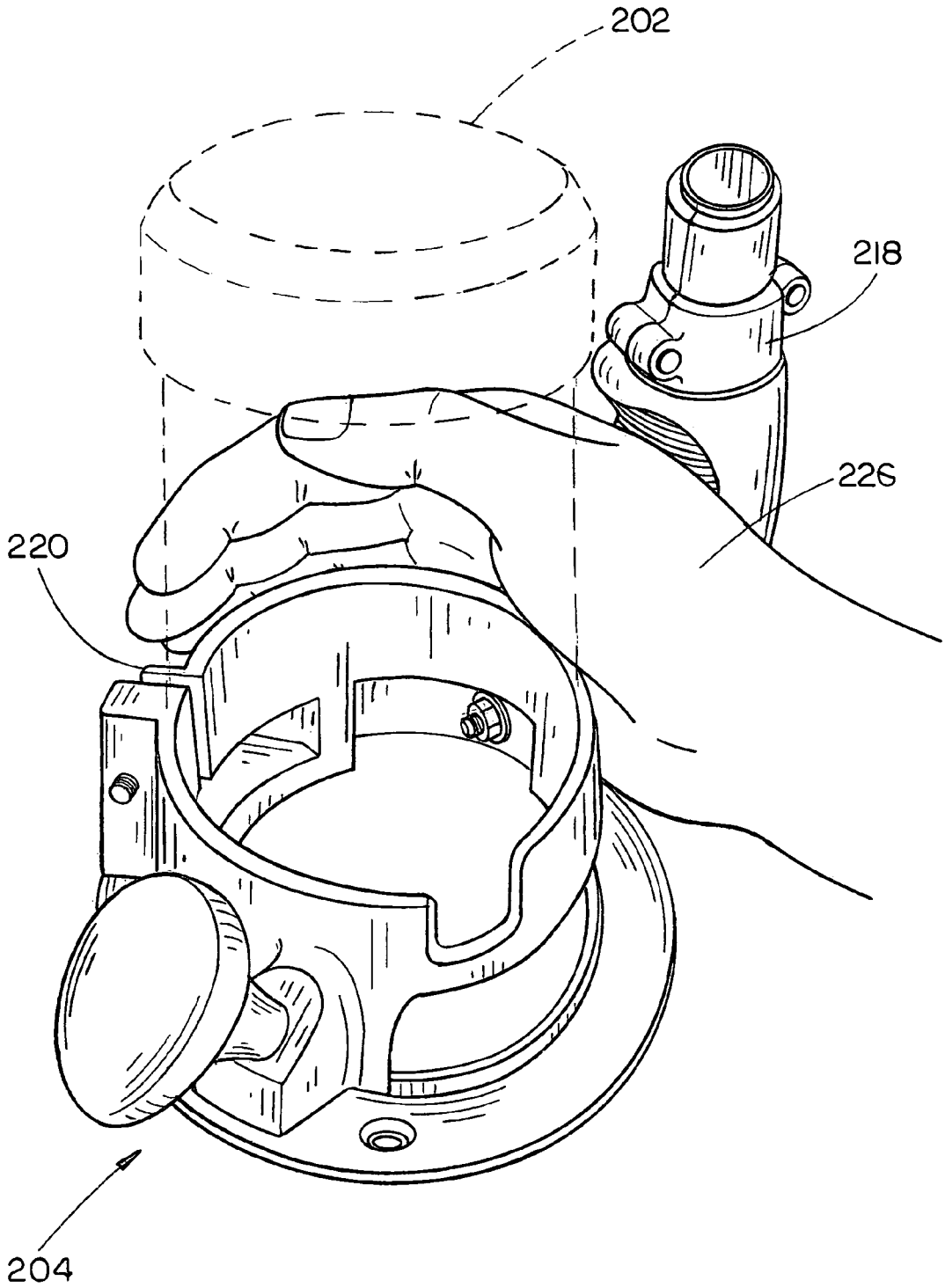
FIG. 2A is a perspective view of a router including a generally L-shaped handle being utilized as a back hand support or stop.
Figure 2B:
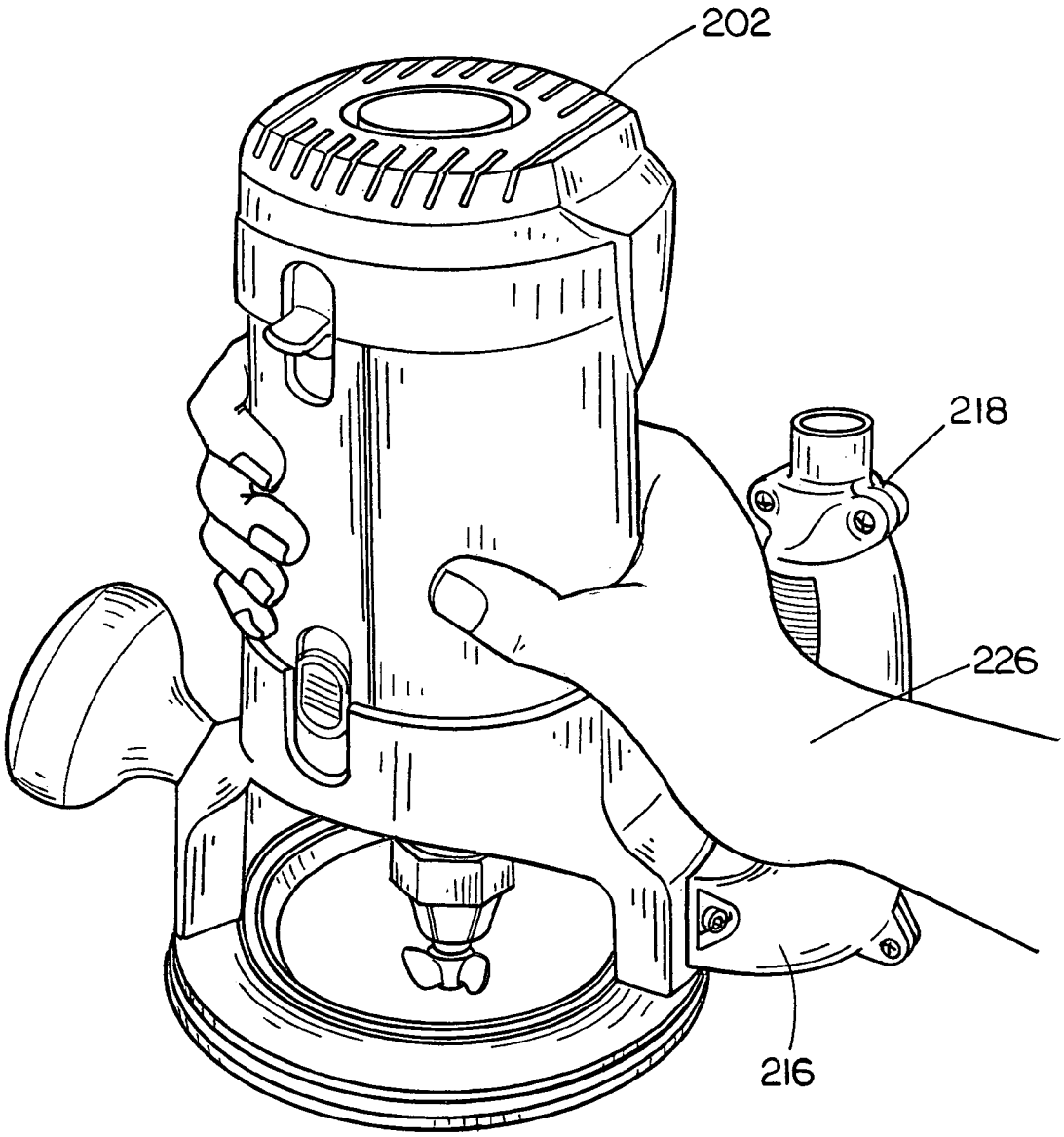
FIG. 2B is an alternate side view of a router including a generally L-shaped handle being utilized as a back hand support or stop

Referring now to FIGS. 1, 2A, and 2B, in the present embodiment, an L-shaped handle 112 is formed with a connecting member 116 and a grasping member 118 extending generally perpendicular to the connecting member 116. In the current embodiment, the connecting member and the grasping member are unitary. Preferably, the grasping member is disposed generally parallel with the motor housing. Configuring the grasping member parallel to the motor housing may help prevent a user from tilting the router, such as when shaping an edge or the like. In additional instances, the connecting member and grasping member are configured to dispose the grasping member 218 proximal to a received motor housing 202/base 204. Positioning the grasping member 218 proximate to the motor housing allows a user to securely control the router without having to grasp the motor housing/base. An L-handle configuration may additionally minimize muscle fatigue (over grasping the motor housing), allow the user close control over the router, and the like. Disposing the L-shaped handle proximate the housing may provide a more comfortable experience, thereby increasing user satisfaction.

Figure 3:
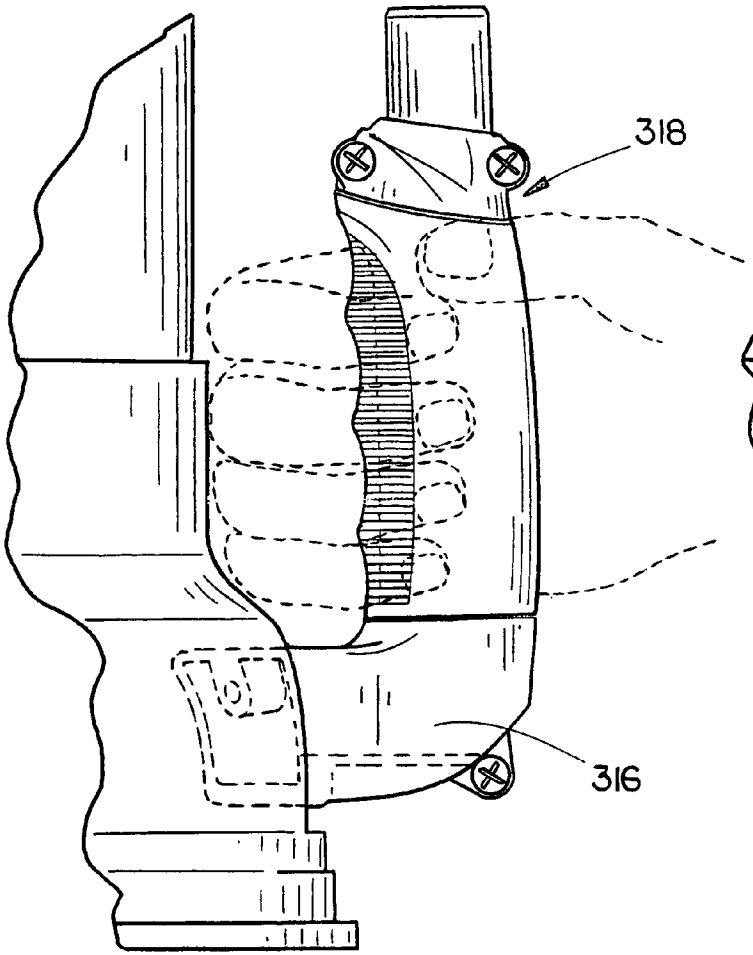
FIG. 3 is a cut-away side view of a router including a generally L-shaped handle being grasped by a user.

In an embodiment, the grasping member 318 is configured to permit a range of human fingers to be disposed between the motor housing/base sleeve when grasping the handle. For example, the connecting member 316 (FIG. 3) is of a length to allow an expected range of user's to grasp the grasping member 318. Those of skill in the art will appreciate that while some additional space may be provided to allow for larger hands, it is preferable to maintain a close proximity to the motor housing for accommodating users who wish to grasp adjacent the main body of the router.

Referring to FIGS. 2A and 2B, a grasping member 218 may be configured to allow a user to extend his or her hand between the motor housing/the router base such that the grasping member 218 acts as a back hand support for users who wish to grasp at least part of the motor housing/router base. Those of skill in the art will appreciate that the grasping member may be disposed to provide additional space to allow a user to comfortably insert his or her hand 226 or to allow people with large hands to utilize the L-shaped handle as a back hand support without departing from the scope and spirit of the present invention. Additionally, the grasping member 218 may be variably connected to the connecting member 216 such as by a screw and slot configuration or the like to allow adjustable positioning of the grasping member with respect to the base.

In further embodiments, the connecting member 116 is configured to at least partially support a user's hand. For instance, a connecting member 116 having a generally rectangular cross-section is implemented to at least partially support a user's hand. The previous configuration may reduce muscle strain associated with a non-supported hand grasping the motor housing/base.

Figure 4:
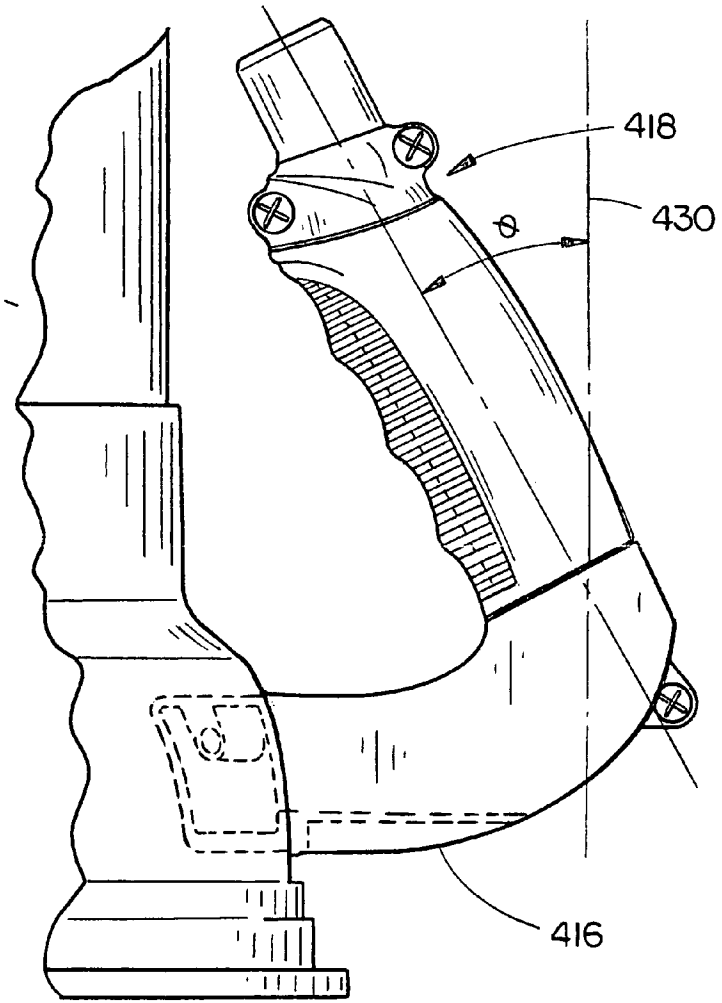
FIG. 4 is a cut-away side view of a router including a generally L-shaped handle in which a grasping member is angled with respect to an axis normal to a connecting member.

Referring to FIG. 4, in alternative implementations, the grasping member 418 is angled θ (theta) between 0° (zero degrees) and 20° (twenty degrees) from an axis 430 normal to the connecting member 416. Angling the grasping member may provide a more comfortable grip and may reduce muscle fatigue for some users and thereby increase user satisfaction. For instance, by angling the grasping member slightly, the user may hold his/her elbow closer to his/her body or accommodate a low work surface or the like.

Figure 5:
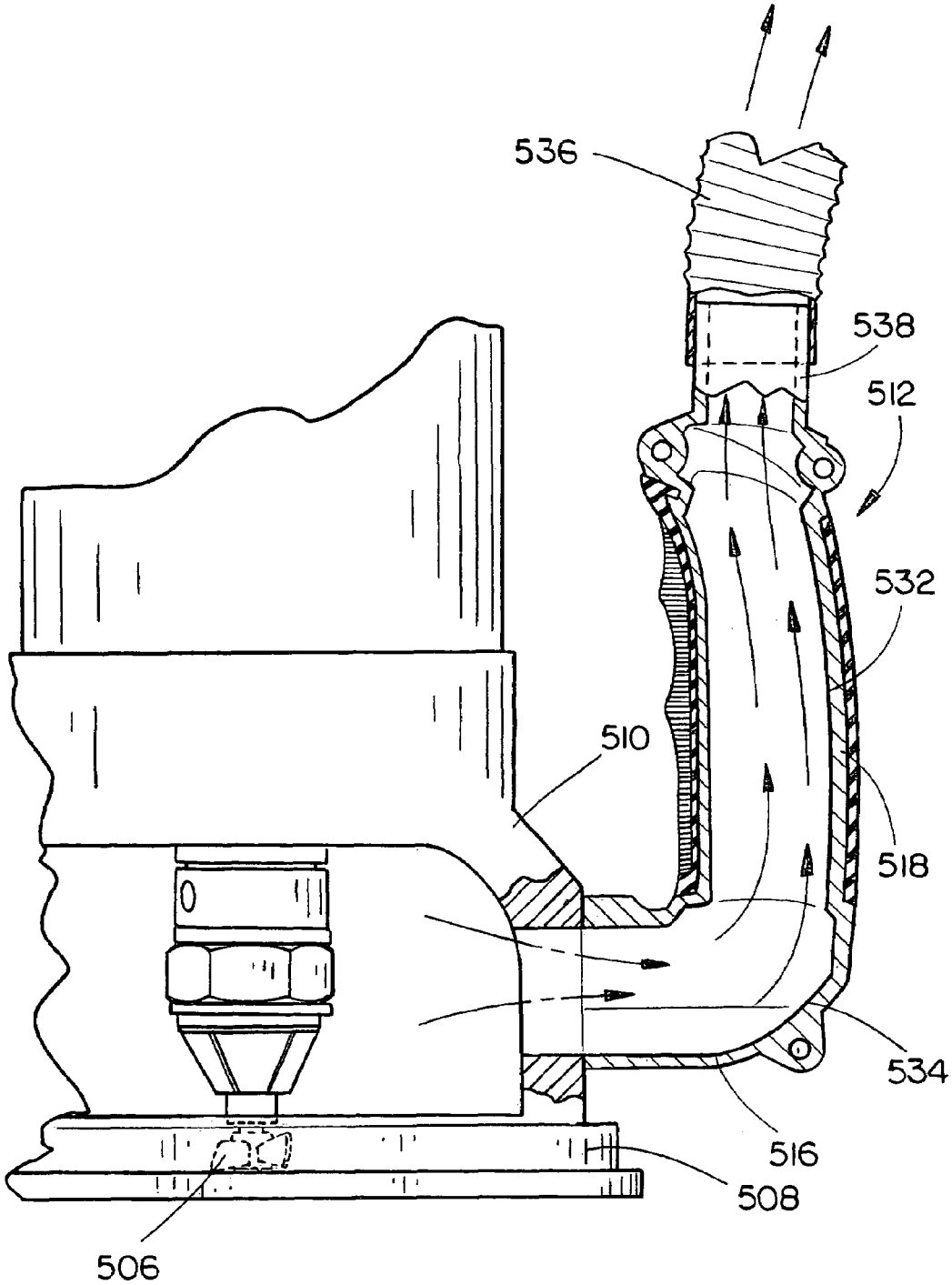
FIG. 5 is cross-sectional view of a router including a generally L-shaped handle with a channel for utilization with a vacuum system.
Figure 6:
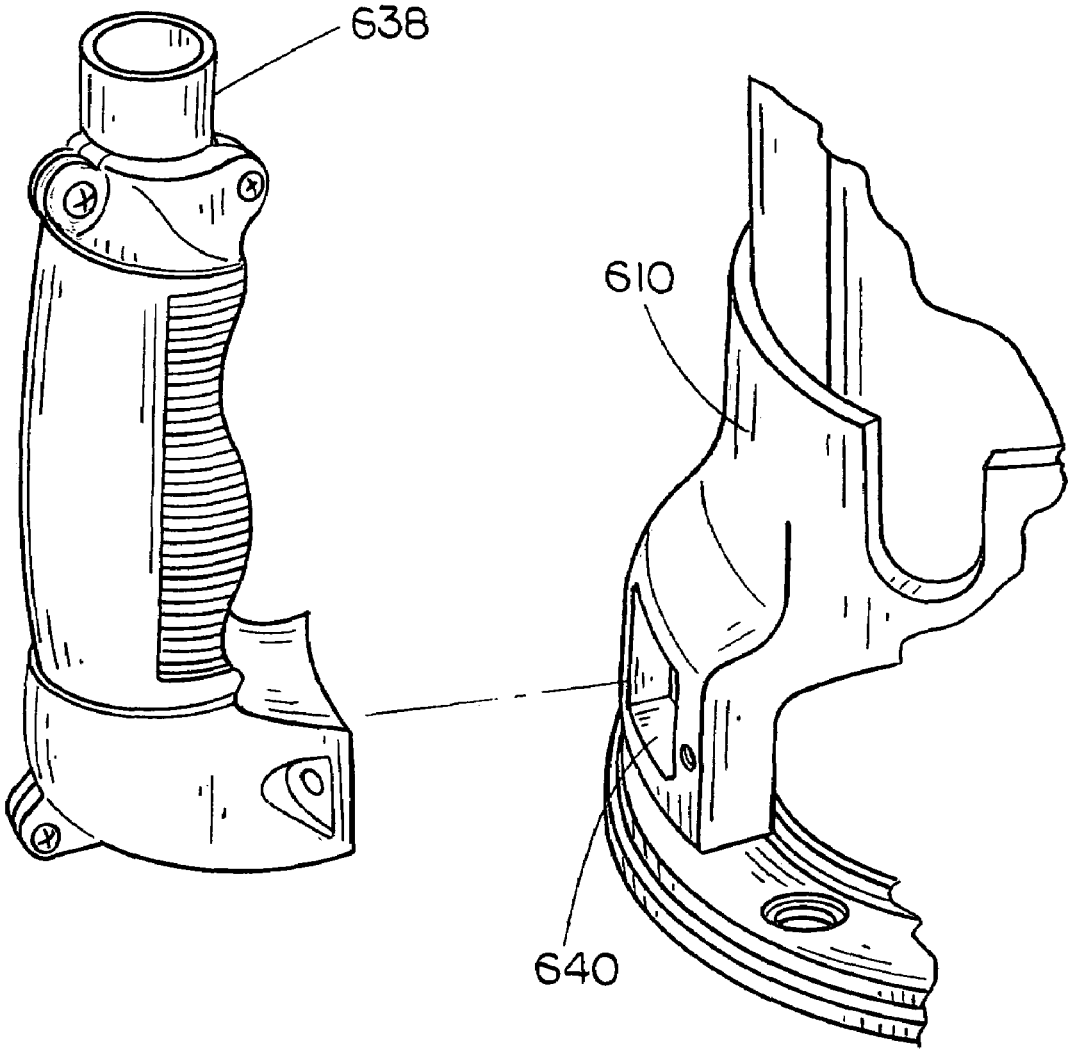
FIG. 6 is an exploded view of a generally L-shaped handle removed from a router base.

Referring now to FIGS. 5 and 6, in further embodiments, an L-shaped handle 512 is formed with a dust and debris channel 532 extending therethrough. Preferably, the L-shaped handle is connected to the base adjacent the interface of the base sleeve 510 and base support member 508 so that dust and debris may be directed towards the channel 532 through normal operation of the router bit 506. Furthermore, a vacuum source coupled via a vacuum hose 536 (also shown as hose 136 in FIG. 1), connected to the handle, may direct dust and debris through the channel 532. Preferably, the channel 532 has a curved surface 534 about the intersection of the segments forming the "L" to assist in directing the debris into the grasping member portion 518 of the channel. In further examples, a securing device is included on the distal end 538 of the L-shaped handle. Suitable securing devices may include a zone 638 for frictionally securing a vacuum hose, tabbed clips, annular protrusions, a collar for accepting a quick release hose clamp included on a vacuum hose, a mechanical connection, biased pins, and the like to secure a hose to the handle.

Referring to FIG. 6, in situations where a removable L-shaped handle is utilized, a plug or cover may be provided for preventing dust from exiting through the dust aperture 640. Suitable covers may connect via fasteners, deformable tabs and the like for securing the cover to the base sleeve 610. For instance, a user desiring to utilize a dual knob handle configuration would remove the L-shaped handle, insert the cover, and attach the knob handle.

Figure 8:
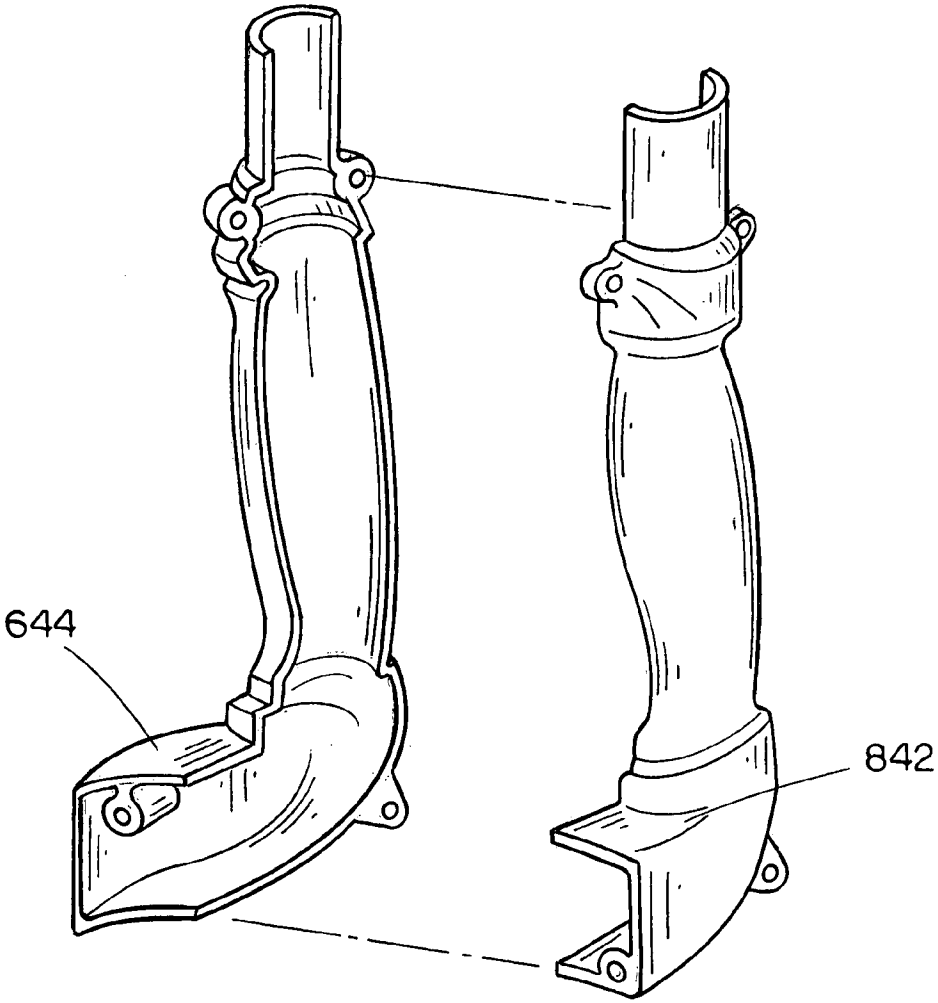
FIG. 8 is an exploded view of a generally L-shaped handle formed from shell portions.
Figure 7:
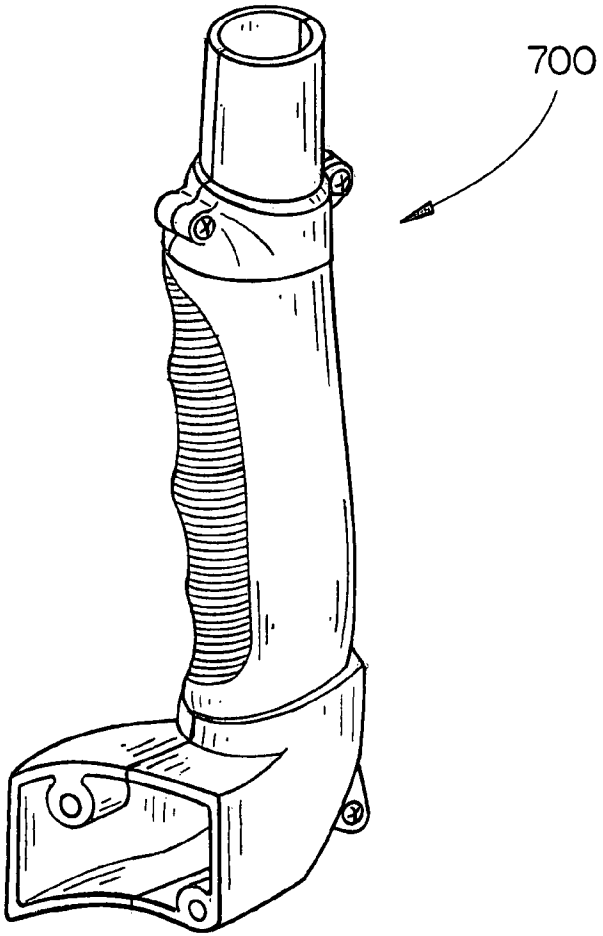
FIG. 7 is an isometric view of a substantially L-shaped handle.

Referring to FIGS. 7 and 8, in exemplary embodiments, an L-handle 700 is formed from shell portions. For instance, when a debris channel is included, the handle may be formed of shell portions (two are shown 842 and 844) with the joint extending lengthwise through the connecting and grasping members for ease of manufacture and the like. Additionally, a mechanical connection such as a lip or interlocking sections may minimize or prevent movement of the shell with respect to the other shell portions and/or may be implemented with a fastener such as a screw, a nut and bolt, or the like to secure the shell portions together.

Figure 9:
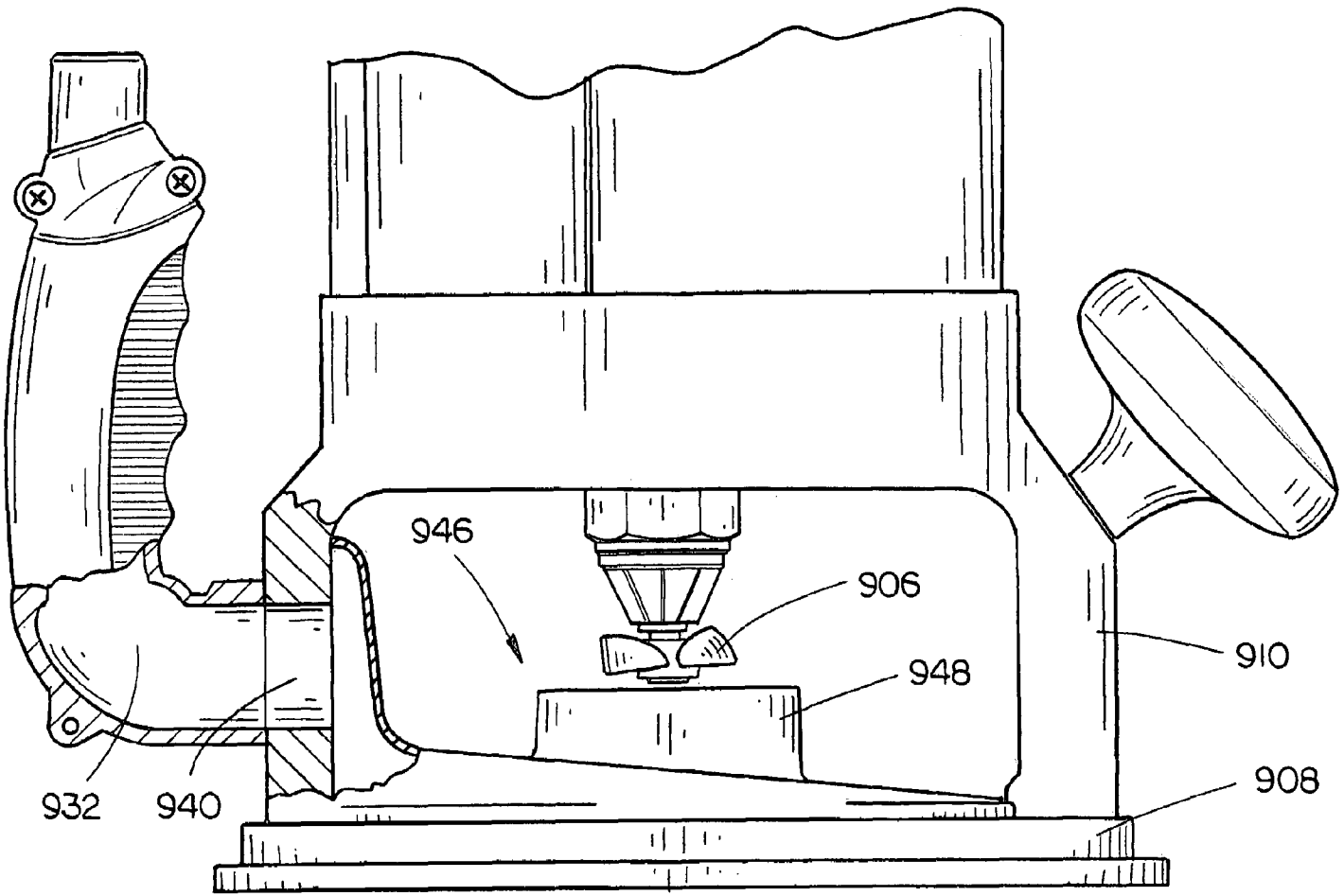
FIG. 9 is a partial cut-a-way view of a router configured with a dust directing housing.

Referring to FIG. 9, in further examples, a dust directing housing 946 is implemented with a router 900 having an L-shaped handle with a debris channel 932. Preferably, the housing 946 is configured to direct dust and debris toward a debris aperture 940 in the base sleeve and subsequently into a channel 932 included the L-handle. The dust housing 946 may removably attach adjacent an associated router bit 906. In the current embodiment, the dust housing 946 is attached to the base support 908 on a side adjacent the base sleeve 910. In further embodiments, the housing is attached in an internal aperture of the base support, between the base support and a removable sub-base. For example, the dust housing 946 is generally cylindrical with an end wall and a side wall at least partially extending around the circumference of the end wall. The side wall may extend about the generally circular end wall with a gap or duct included to align with a dust aperture included in the base sleeve. A dust housing may have a generally wedge shaped profile with the maximum height of the side wall adjacent the debris aperture 940 to direct dust and debris toward the handle during normal operation. A shroud 948 may be included to extend from the end wall, opposite the side wall, to minimize dust and debris from escaping around the router's collet and bit shank. For instance, a shroud may terminate adjacent the collet end of a motor housing to minimize escaping dust and debris. Preferably, a dust housing's central aperture is configured so that the housing 946 does not interfere with normal operations. For instance, the central aperture is configured to be utilized with a large profiling bit such as an ogee bit or the like. A dust housing may attach to the base or sub-base via a twist interlock, snaps, fasteners, and the like to secure the housing to the router. Those of skill in the art will appreciate that the dust housing of the present embodiment may be integrally formed with a sub-base to attach to the base support on a side opposite the base sleeve. Furthermore, the dust housing may be formed from transparent material to allow a user to observe router operation.

Referring again to FIG. 1, preferably an L-shaped handle 112 includes a grip such as a universal grip 122. A universal grip 122 may be contoured to promote comfortable grasping by people with various sized hands. Other suitable grips include oblong or a "banana" grips, sleeve type grips, grips coated on the handle, or the like for promoting comfortable grasping by the user. Suitable grip materials include vibration dampening materials, plastic, materials for wicking away sweat, elastomeric type materials, materials for assisting in maintaining a firm grasp (such as by having an appropriate coefficient of friction) and the like. In another example, grip material is coated on the grasping member to minimize vibration, decrease muscle strain and the like. In exemplary embodiments, a universal grip 122 includes ribs or protrusions directed inwardly toward a received motor housing. These protrusions may at least partially deform or bend upon grasping/contacting the back of a user's hand (when grasping the motor housing) to accommodate various sized hands and the like. In further examples, at least a portion of a connecting member is coated with vibration dampening material to minimize vibrations transferred through the handle.

It is believed that the apparatus of the present invention and many of its attendant advantages will be understood by the foregoing description. It is also believed that it will be apparent that various changes may be made in the form, construction and arrangement of the components thereof without departing from the scope and spirit of the invention or without sacrificing all of its material advantages. The form herein before described being merely an explanatory embodiment thereof. It is the intention of the following claims to encompass and include such changes.

What is claimed is:

1. A power tool, comprising:

a motor housing adapted to house a motor that is configured to drive a working tool;

a base coupled to the motor housing, said base for supporting the motor housing on a surface, said base including a member configured to clamp the base about the motor housing; and a generally L-shaped handle, having a connecting member coupled to the base and a grasping member, said handle for manipulating the power tool on the surface, wherein the handle defines a channel therethrough with a terminal portion adapted to be attached to a vacuum source that is external to the power tool.

2. The power tool of claim 1, wherein the base is removable from the motor housing.

3. The power tool of claim 1, wherein the base includes:

a base sleeve including a generally cylindrical aperture therein for receiving the motor housing; and a support member connected to the base sleeve, said support member for supporting the power tool on a workpiece, wherein the generally L-shaped handle is connected to the base sleeve adjacent the interface of the base sleeve and the support member.

4. The power tool of claim 1, further comprising a universal grip coupled to the grasping member, said universal grip being configured to be grasped by various sized human hands.

5. The power tool of claim 1, further comprising a grip coupled to the generally L-shaped handle, said grip being coupled to the L-shaped handle by at least one or more of the following: coating the grip on at least a portion of the generally L-shaped handle, frictionally securing the grip to the generally L-shaped handle, or securing the grip via a fastener to the generally L-shaped handle.

6. The power tool of claim 1, further comprising a generally oblong grip coupled to the generally L-shaped handle.

7. The power tool of claim 1, wherein the grasping member is substantially parallel to the motor housing.

8. The power tool of claim 1, wherein the generally L-shaped handle is removable.

9. The power tool of claim 1, wherein the generally L-shaped handle is connected to the base via a fastener.

10. The power tool of claim 1, further comprising a grip connected to the generally L-shaped handle, said grip being formed of vibration dampening material.

11. The power tool of claim 1, wherein the generally L-shaped handle is formed from shell portions.

12. The power tool of claim 1, wherein the grasping member is adjustably positionable.

13. The power tool of claim 1, wherein the connecting member is configured to support at least a portion of a human hand disposed between the motor housing and the grasping member.

14. The power tool of claim 1, wherein the power tool is configured to permit at least a portion of a user's hand to extend between the motor housing and the grasping member.

15. The power tool of claim 1, wherein the grasping member forms a back hand support for a user's hand when grasping at least a portion of the motor housing.

16. A power tool, comprising:

a motor housing adapted to house a motor that is configured to drive a working tool;

a base coupled to the motor housing, said base for supporting the motor housing on a surface, said base including a member configured to clamp the base about the motor housing;

a generally L-shaped handle, having a connecting member coupled to the base and a grasping member, said handle for manipulating the power tool on a workpiece; and a grip coupled to the grasping member and having a plurality of protrusions directed inwardly toward the motor housing.

17. The power tool of claim 16, wherein the grip is configured for grasping by various sized human hands.

18. The power tool of claim 16 wherein the grip is coupled to the L-shaped handle by at least one or more of the following: coating the grip on at least a portion of the generally L-shaped handle, frictionally securing the grip to the generally L-shaped handle, or securing the grip via a fastener to the generally L-shaped handle.

19. The power tool of claim 16, wherein the grip comprises a generally oblong grip.

20. The power tool of claim 16, wherein the grasping member is substantially parallel to the motor housing.

21. The power tool of claim 16, wherein the generally L-shaped handle is removable.

22. The power tool of claim 16, wherein the generally L-shaped handle is connected to the base via a fastener.

23. The power tool of claim 16, wherein the grasping member includes a terminal zone for coupling a vacuum hose thereto.

24. The power tool of claim 16, wherein the grip comprises a vibration dampening material.

25. The power tool of claim 16, wherein the generally L-shaped handle defines a channel formed therethrough.

26. The power tool of claim 25, wherein the generally L-shaped handle is formed from shell portions.

27. The power tool of claim 16, wherein the grasping member is adjustably positionable.

28. The power tool of claim 16, wherein the grasping member is angled between 0° (zero degrees) and 20° (twenty degrees) from an axis normal to the connecting member.

29. The power tool of claim 16, wherein the grip is configured to support at least a portion of a human hand disposed between the motor housing and the grasping member.

30. The power tool of claim 16, wherein the grip is configured to permit at least a portion of a user's hand to extend between the motor housing and the grasping member.

31. The power tool of claim 30, wherein the grip forms a back hand support for a user's hand when grasping at least a portion of the motor housing.

32. The power tool of claim 1, wherein the grasping member is at an angle to the motor housing.

33. The power tool of claim 1, wherein the grasping member and the connecting member are at a substantially right angle with one another.

34. The power tool of claim 1, wherein the grasping member and the connecting member are at an angle of less than 90 degrees to one another.

35. The power tool of claim 1, wherein the external vacuum source is not integral with the motor housing.

36. The power tool of claim 1, wherein the grasping member is disposed proximal the motor housing.

37. The power tool of claim 1, wherein the base defines a seam and the member is configured to clamp the base across the seam.

38. The power tool of claim 37, wherein the member comprises at least one of a clamp and a draw member.

39. The power tool of claim 16, wherein the base defines a seam and the member is configured to clamp the base across the seam.

40. The power tool of claim 39, wherein the member comprises at least one of a clamp and a draw member.

41. The power tool of claim 1, wherein the member comprises a clamp for releasably clamping the base about the motor housing.

42. The power tool of claim 16, wherein the member comprises a clamp for releasably clamping the base about the motor housing.

* * * * *